US005292043A

United States Patent [19]

McHale

[11] Patent Number: 5,292,043

[45] Date of Patent: Mar. 8, 1994

[54] EXTENSIBLE FRAME BACKPACK

[76] Inventor: Daniel M. McHale, 29 Dravus St., Seattle, Wash. 98109

[21] Appl. No.: 476,835

[22] Filed: Feb. 7, 1990

[51] Int. Cl.[5] ..... A45F 3/08

[52] U.S. Cl. ..... 224/210; 224/261

[58] Field of Search ..... 224/209, 210, 211, 212, 224/213, 261, 263

[56] References Cited

U.S. PATENT DOCUMENTS

| | | | |
|---|---|---|---|
| 227,166 | 5/1880 | Hoffman | 224/213 |
| 3,233,803 | 2/1966 | Gray | 224/263 |
| 3,912,138 | 10/1975 | Pava | 224/211 X |
| 3,946,916 | 3/1976 | Lawrence | 224/262 |
| 4,015,759 | 4/1977 | Dreissigacker | 224/263 |
| 4,018,370 | 4/1977 | Wood | 224/263 |
| 4,356,942 | 11/1982 | Hayes | 224/211 |
| 4,433,802 | 2/1984 | Woolf | 224/213 |
| 4,593,841 | 6/1986 | Lange | 224/210 X |

FOREIGN PATENT DOCUMENTS

| | | | |
|---|---|---|---|
| 257142 | 3/1988 | European Pat. Off. | 224/213 |
| 284767 | 10/1988 | European Pat. Off. | 224/213 |
| 159664 | 2/1904 | Fed. Rep. of Germany | 224/210 |
| 53574 | 2/1934 | Norway | 224/209 |
| 2178646 | 2/1987 | United Kingdom | 224/213 |

*Primary Examiner*—Glenn J. Barrett
*Attorney, Agent, or Firm*—Russell W. Illich

[57] ABSTRACT

A single backpack is provided for allowing a simple conversion between an extended form for long duration hikes and a collapsed form for short technical climbs on ice and rock. The backpack comprises a frame that includes a pair of aluminum bars fastened to a frame surface of the pack. The main frame bars extend partially up the frame surface of the pack shell. The remaining distance from the top of the main frame bars and the top of the shell is spanned by extension bars which are held and fastened against the main frame bars. The main frame bars, with the addition of the extension bars, make the backpack a full sized large capacity hiking pack capable of bearing loads of 70 pounds or more. The backpack may be converted to a climbing pack by removing the extension bars from their fastened position and subsequently the shell collapses to the level of the lower main frame. The extension bars are easily unfastened and may be carried within the pack or stored with other non-essential pack gear at the base of the climb.

6 Claims, 1 Drawing Sheet

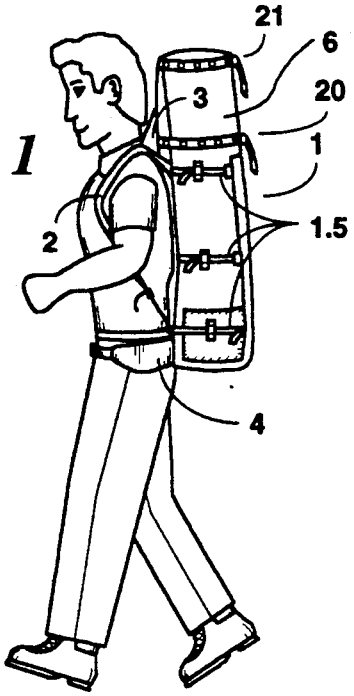
Fig. 1
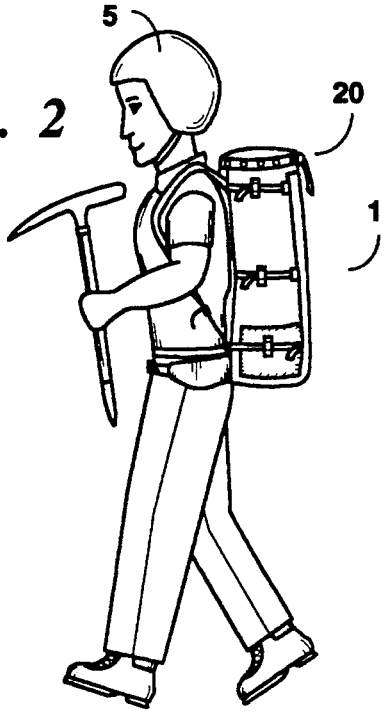
Fig. 2
Fig. 3
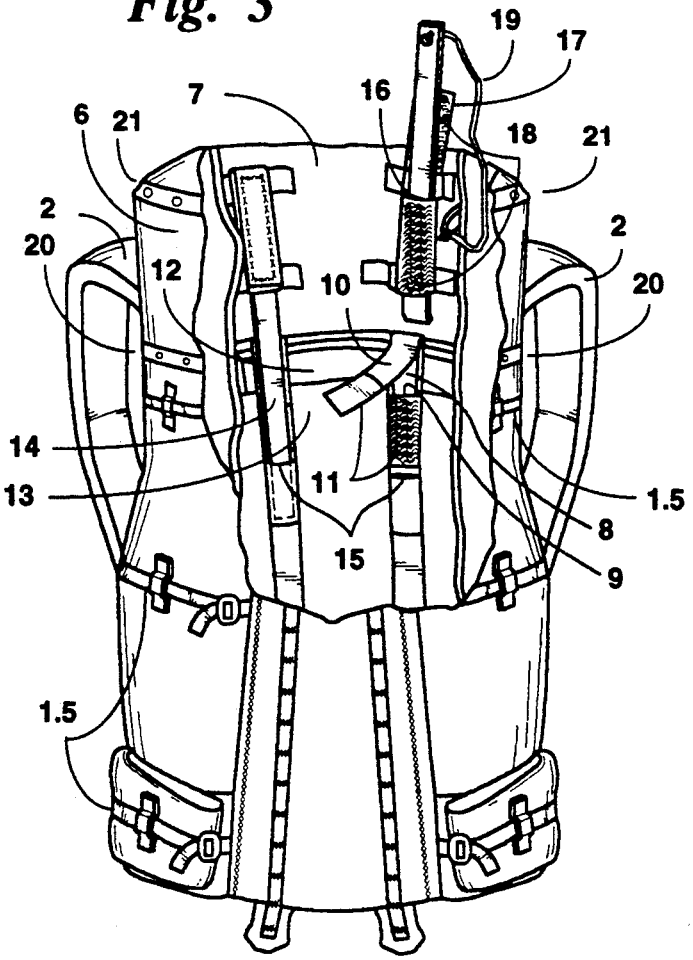
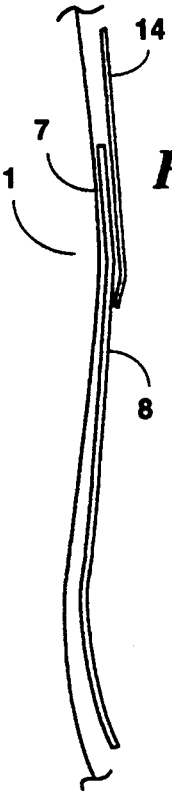
Fig. 4

EXTENSIBLE FRAME BACKPACK

BACKGROUND OF THE INVENTION

The present invention relates to backpacks and particularly to backpacks used in hiking and climbing. Within the field of hiking packs there is a distinction between packs used on long, relatively lowland type hikes, and packs used on mountain climbing expeditions. Many long hikes require large capacity packs that are capable of carrying food and supplies weighing in excess of 70 pounds. Large capacity packs in common use, today, generally are very tall and bulky packs. These packs are unsuitable for the relatively short climbs that hikers take upon arriving at the base of a mountain. The short mountain climbs do not require the hiker to carry all of his/her gear to reach the summit. It is much more convenient for a hiker to use a smaller pack that does not limit their movement while engaged in a technical climb of ice and/or rock.

Currently, hikers have few options in resolving the different backpack requirements on different stages of a hike. Some hikers carry a smaller backpack for technical climbs within their large capacity pack. this method requires the purchase of two separate packs and uses up extra space and weight within the large pack in carrying the small pack. Other hikers remove the exterior or interior frame from the shell of the large capacity pack and collapse the shell for use as a smaller pack. This method requires the painstaking steps of disassembling and reassembling the large pack. Furthermore, without a frame, the collapsed shell does not give the climber as much support for the load he/she is carrying within the shell. Finally, most hikers and climbers do not use either of the methods above, but instead, compromise by using a pack that is too large for comfortable climbing or is too small to carry a very heavy load on a hike of long duration.

The difference in use between hiking backpacks and climbing packs gives rise to an unresolved problem for the hiker. There are currently no backpacks available to the general public that resolve this problem of carrying two packs, or of needing two different frame lengths for a pack, and/or compromising on the size of the pack.

SUMMARY OF THE INVENTION

It is an object of this invention to provide a single backpack that functions as both a large capacity hiking pack and a small technical climbing pack, with both having frames.

Another object of the invention is to provide a backpack that gives a hiker full maneuverability of his/her head.

Another object of the invention is to provide a backpack that provides a full frame whether in an extended hiking form or a smaller climbing form.

Another object of the invention is to provide a backpack that is adjustable in size for any use including hiking, climbing, or general traveling.

It is a further object of the invention to provide a single backpack that is convertible between its two forms in an easy and convenient manner.

Other objects of the invention will be apparent hereinafter from the specification and from the recital of the appended claims, particularly when read in conjunction with the accompanying drawings.

The present invention comprises a large capacity hiking backpack convertible to a smaller climbing pack.

The backpack comprises an internal frame that includes a pair of aluminum bars fastened to an internal frame surface of the shell of the pack. The internal frame surface is on the opposite side of an external surface of the shell which has a pair of shoulder straps attached thereto. The main frame bars extend part way up the internal frame surface of the shell. The remaining distance from the top of the main frame bars and the top of the shell is spanned by extension bars which are held and fastened against the main frame bars and the internal frame surface. The main frame bars, with the addition of the extension bars, make the backpack a full sized large capacity hiking pack. The backpack has a second form as a climbing pack through the removal of the extension bars from their fastened position and subsequent vertical collapse of the shell, via use of the lower of the two drawstrings, to a smaller or shorter frame. The extension bars are easily unfastened and may be carried within the pack or stored with other gear at the base of the climb.

The backpack is easily converted between its extended hiking form and its collapsed climbing form. The extended form gives the pack its full capacity as a large hiking pack capable of bearing 70 pounds or more. The collapsed form allows the climber full maneuverability of his/her head and neck while scaling ice and/or rock without the compromise of climbing with a frameless or oversized pack.

BRIEF DESCRIPTION OF THE DRAWINGS

FIG. 1 shows a side plan view of the backpack of the present invention in a fully extended form for use as a hiking pack.

FIG. 2 shows a side plan view of the backpack of FIG. 1 in a collapsed form for use as a technical climbing pack.

FIG. 3 shows a partially cutaway perspective view of the backpack of FIG. 1.

FIG. 4 shows a partial side view of the main frame bar, extension bar, and the internal frame surface of the backpack of FIG. 1.

DETAILED DESCRIPTION OF THE INVENTION

FIG. 1 shows a preferred embodiment of the backpack and frame of the present invention in its extended form as a hiking pack. The pack includes an outer shell 1 that is supported by a pair of shoulder straps 2 attached to an external surface of the shell opposite a person's back. Recent developments within hiking packs include the use of lifting straps 3 which hoist the pack 1 off of the top of a person's shoulders to relieve stress within the shoulders that developes over a long hiking period. The lifting straps are attached to the top of the pack adjacent the extension frame bars (which will be explained, below) in order to lift the entire frame off of the hiker's shoulders, as shown. A waist belt 4 is attached to the bottom of the shell 1 for holding the pack upon the hiker's hips. When the pack is in its extended form, the top of the pack lies directly behind the back of a hiker's head, as shown in FIG. 1. A top lid, which covers the drawstring openings during bad weather, is available as an accessory and can serve a double function as a hip pack (fanny pack). Such accessories can give the pack an overall height that extends above the top of a hiker's head. Securing the top lid also serves to stabilize the load whether it is extended or collapsed. On relatively lowland non-technical hikes, the extended height of the pack is not cumbersome to the hiker and allows the hiker to carry additional weight for food and supplies which may be needed on hikes of long duration. Also serving to stabilize the load, and to hold it against the frame surface, are compression straps 1.5.

FIG. 2 shows the pack shell 1 in its collapsed form for use as a climbing pack. The pack extension sleeve 6 has been tucked down inside the pack and the lower drawstring 20 drawn. Technical climbs on ice and rock often require greater freedom of movement and clearance for a climber's head, neck, and shoulders. An extended hiking pack does not serve a climber very well especially if the climber is wearing a helmut 5, as shown. Thus, a collapsed pack 1, as shown in FIG. 2, is much more functional for a climber than a tall hiking pack because it allows the climber to tilt his/her head back when scaling high angle rock and ice. The pack 1 maintains its fully rigid internal frame, albeit a shortened one, giving the climber full support of the load within the pack. The painstaking method of removing the entire frame from a hiking pack to arrive at a smaller climbing pack is not needed with the backpack of the present invention. Extension bars within the internal frame are merely removed (as will be explained hereinafter) and the shell 1 collapsed down to the level of the lower main frame via the use of the lower of the two drawstrings 20 at the top of the pack, as shown in FIG. 2.

FIG. 3 shows in full detail, the internal frame of the backpack of the present invention. The backpack shell 1 has an exterior surface 6 upon which a pair of shoulder straps 2 are mounted upon the back side of the pack (not shown in FIG. 3). An internal frame surface 7 of the shell is shown in the cutaway section of FIG. 3. A pair of main frame bars 8 are secured within a pair of stitched pockets 9 on the internal frame surface 7. The main frame bars, currently, are made of aluminum for strength and flexibility. The bars 8 extend from the bottom of the pack to a predetermined point on the upper end of the frame surface 7. The top of the main bars are held by a flap 10 which includes a downwardly extending pocket (not shown) to hold the top of bar 8. The flap 10 and pocket 9 include a fastening arrangement which can be opposed velcro sections 11, as shown. Pockets 9, which hold the main frame bars 8, extend down the entire length of the interior backpack frame surface. The frame surface also includes a foam pad 12 that is held within a pocket 13 on the frame surface. Pocket 13 also serves as a storage area for the extension bars 14. The pad 12 gives rigidity to the frame surface and protects a hiker's back from direct contact with the aluminum bars of the frame.

The extension feature of the present invention comprises a pair of extension bars 14 which are held within extension pockets 15 that are sewn over the top of the main bar pockets 9. Thus, the bars 14 overlap the main bars and are effectively fastened to the main bars to provide a single extended frame. FIG. 4 shows the overlapping feature of the extension bar 14 with the main frame bar 8 upon the internal frame surface 7. In the preferred embodiment, ⅔ of the length of the extension bar overlaps with the main frame bar, while ⅓ of the length of the extension extends over the top of the main bar to give the pack its extensible feature. The extension bar shown on the right side of FIG. 3 further shows detail of the means for fastening the extension bar to the internal frame surface 7. The extension bar is initially inserted through an upper loop 16 and further inserted down into extension bar pocket 15 where the bar 14 is held in place. The top of bar 14 is fastened to the internal frame surface 7 by an upper flap 17 which folds over the top of the bar (as shown in hidden lines on the left side of FIG. 3) and fastened to the loop 16 by opposed fasteners 18 such as Velcro. The extension bar 14 of the preferred embodiment includes a tether 19 which removably secures the bar to pack 1, so that the bar will not be misplaced or lost. The extension bars 14 are generally stored in pocket 13.

The operation of the extension feature of the pack 1 is simple and straightforward. When using the pack as a hiking pack for long duration hikes, the pack may be converted to its extended form, as shown in FIG. 1, by inserting the extension bars 14 through loops 16 and into pockets 15 where they are held in place. The bars are securely fastened by flaps 17 as shown on the left side of FIG. 3. In the extended form, the pack has a capacity of 70 pounds or more. To use the pack as a climbing pack, the extension bars 14 are removed from pockets 15 and loops 16 and are stored inside foam pocket 13. The shell 1 is subsequently collapsed down inside itself and the lower drawstring 20 pulled. In the collapsed form of the backpack, the pack frame is 4 to 7 inches shorter and the overall pack length, without additional accessories on top, can be ever shorter. The shorter pack allows greater movement of a climbers head and neck when scaling steep terrain. In the collapsed form, the pack has a capacity of approximately 30–40 pounds which is optimal for climbing. The collapsed form of the pack 1 has a great advantage over current methods of removing the shell from a pack frame and using the bare shell as a climbing pack. The advantage of pack 1 is that the conversion is simple and easy to achieve while still maintaining a main pack frame for use in supporting the load within the pack.

It should be apparent that many modifications could be made to the extensible backpack which would still be encompassed within the spirit of the present invention. For instance, the extensible feature could involve telescoping members, or even hinged members, instead of overlapping bars, and the extensible feature could be used on external frame backpacks, as well as internal frame backpacks. It is intended that all such modifications may fall within the scope of the appended claims.

What is claimed is:

1. An extensible backpack, comprising:

a pack shell having an internal compartment, said compartment capable of defining at least two predetermined volumes, a first volume for holding a maximum amount of load within the backpack and a second volume for holding a load less than a maximum load;

means for converting said internal compartment from said first volume to said second volume and from said second volume to said first volume;

a frame surface for supporting said pack shell, said frame surface having a main frame member, said frame surface further including means to hold and secure said main frame member to said frame surface;

said main frame member connected to said frame surface, and said frame surface attached directly to said pack shell;

an extension frame member for extending said main frame member, said extension frame member including means to hold and secure said extension frame member to said frame surface in an extended position, and said extension frame member having means to position said extension frame member in a second position, said second position defining a shortened overall length of said frame surface;

said frame surface forms a part of an internal surface of said pack shell;

wherein, said extension frame member is capable of extending the backpack to a full height such that said first volume of said pack shell is fully supported by said main frame member and said extension frame member, said backpack capable of being converted to a shortened position such that said second volume of said pack shell is fully supported by said main frame member.

2. An extensible backpack as claimed in claim 1, wherein said main frame member comprises at least one bar extending vertically across said frame surface and said extension frame member comprises a bar having a first portion and a second portion, said first portion overlapping said main frame member and a second portion which extends above the top of said main frame member when said extension bar is in said extended position.

3. An extensible backpack as claimed in claim 1, wherein said extension frame member is removable from said frame surface to define or isolate said main frame.

4. An extensible backpack as claimed in claim 1, wherein said means for converting said internal compartment from said first volume to said second volume includes means for collapsing said shell against said frame surface in either said extended position, or said collapsed position.

5. An extensible backpack, comprising:

a pack shell having an internal compartment, said compartment capable of defining at least two predetermined volumes, a first volume for holding a maximum amount of load within the backpack and a second volume for holding a load less than a maximum load;

means for converting said internal compartment from said first volume to said second volume and from said second volume to said first volume;

a frame surface for supporting said pack shell, said frame surface having a main frame member, said frame surface further including means to hold and secure said main frame member to said frame surface;

said main frame member connected to said frame surface, and said frame surface attached directly to said pack shell;

an extension frame member for extending said main frame member, said extension frame member including means to hold and secure said extension frame member to said frame surface in an extended position, and said extension frame member having means to position said extension frame member in a second position, said second position defining a shortened overall length of said frame surface;

said means to hold said extension frame member in an extended position includes a pocket secured to said frame surface and said means to secure said extension frame member includes a loop connected to said frame surface for surrounding a portion of said extension frame member and a flap connected to said frame surface for holding the top of said extension frame member;

wherein, said extension frame member is capable of extending the backpack to a full height such that said first volume of said pack shell is fully supported by said main frame member and said extension frame member, said backpack capable of being converted to a shortened position such that said second volume of said pack shell is fully supported by said main frame member.

6. An extensible backpack as claimed in claim 5, further comprising, fastening means to secure said flap to said loop.

* * * * *